US009067104B1

(12) United States Patent
Kim

(10) Patent No.: US 9,067,104 B1
(45) Date of Patent: Jun. 30, 2015

(54) TRANSFORMABLE FITNESS DEVICE AND METHOD OF USE

(71) Applicant: David Seon Kim, Waxhaw, NC (US)

(72) Inventor: David Seon Kim, Waxhaw, NC (US)

( * ) Notice: Subject to any disclaimer, the term of this patent is extended or adjusted under 35 U.S.C. 154(b) by 219 days.

(21) Appl. No.: 13/826,796

(22) Filed: Mar. 14, 2013

(51) Int. Cl.
*A63B 21/00* (2006.01)
*A63B 22/20* (2006.01)

(52) U.S. Cl.
CPC ..... *A63B 22/20* (2013.01)

(58) Field of Classification Search
USPC ..... 482/49, 141, 132
See application file for complete search history.

(56) References Cited

U.S. PATENT DOCUMENTS 6,575,883 B1 6/2003 Hinds
7,468,025 B2 12/2008 Hauser
8,702,574 B2 * 4/2014 Abranchess ..... 482/141

* cited by examiner

*Primary Examiner* — Jerome W Donnelly
(74) *Attorney, Agent, or Firm* — Ted Masters

(57) ABSTRACT

A transformable fitness device includes two assemblies which when unconnected can be used as push-up exercise devices, and when connected can be used as an exercise wheel. Each of the two assemblies include a handle holder which is rotatably connected to a base. The bases of the two assemblies can be connected together so that the two connected assemblies form an exercise wheel. In an embodiment, the bases slidably interlock together.

14 Claims, 12 Drawing Sheets

Fig. 2
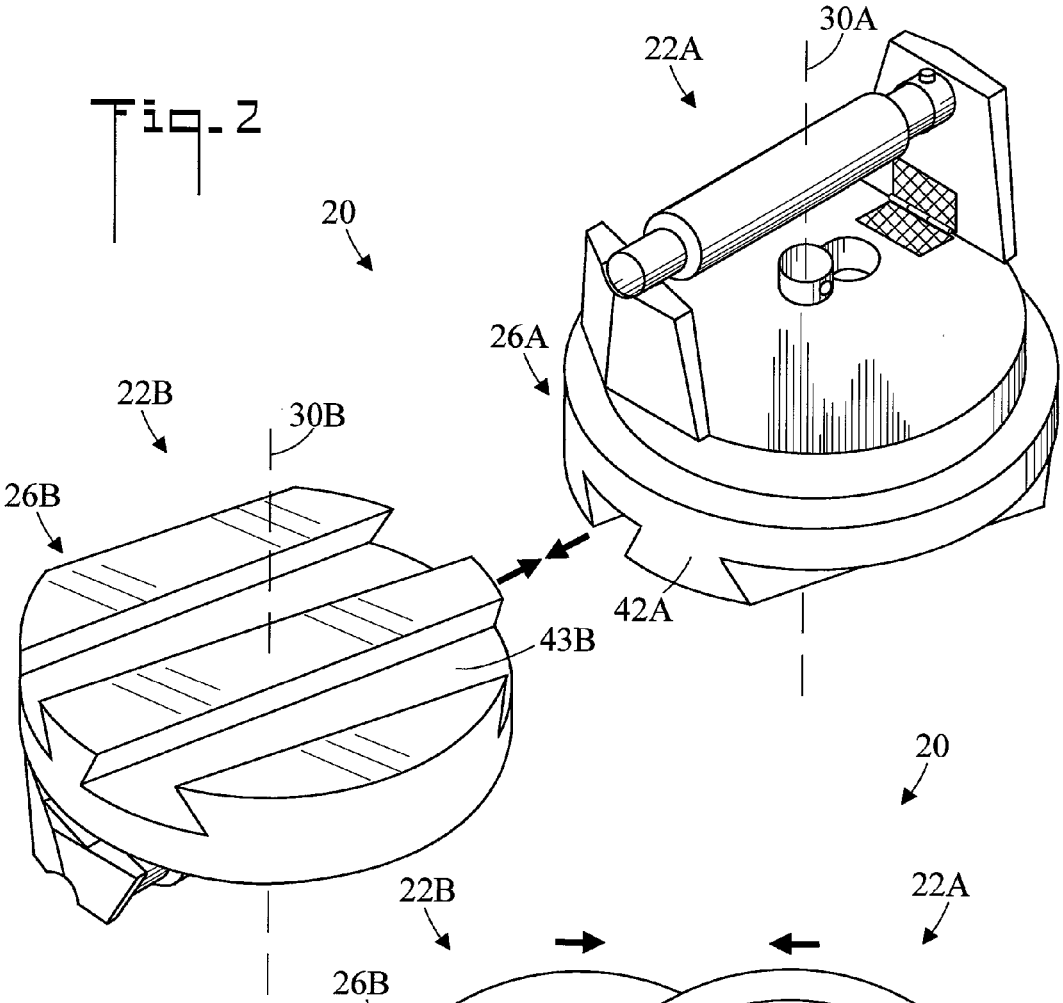
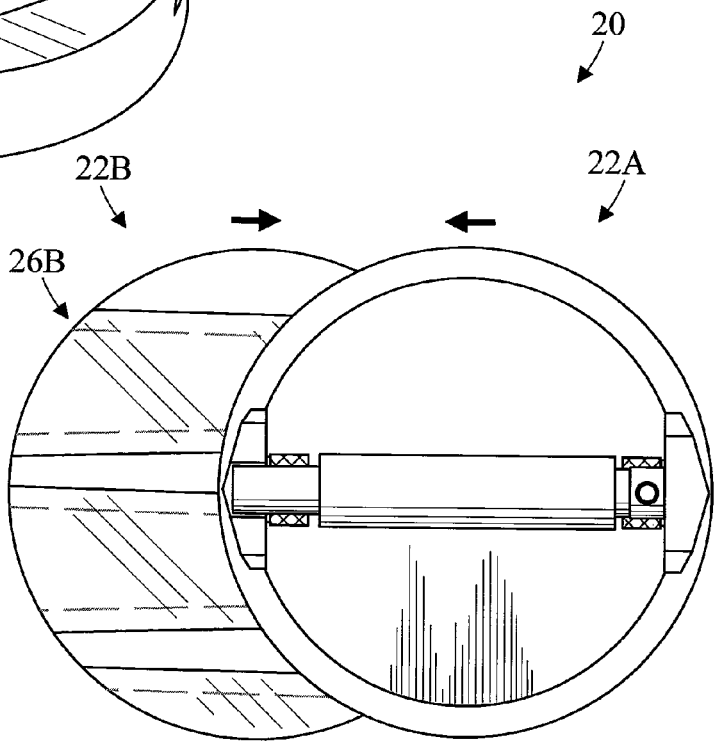
Fig. 3

Fig. 4
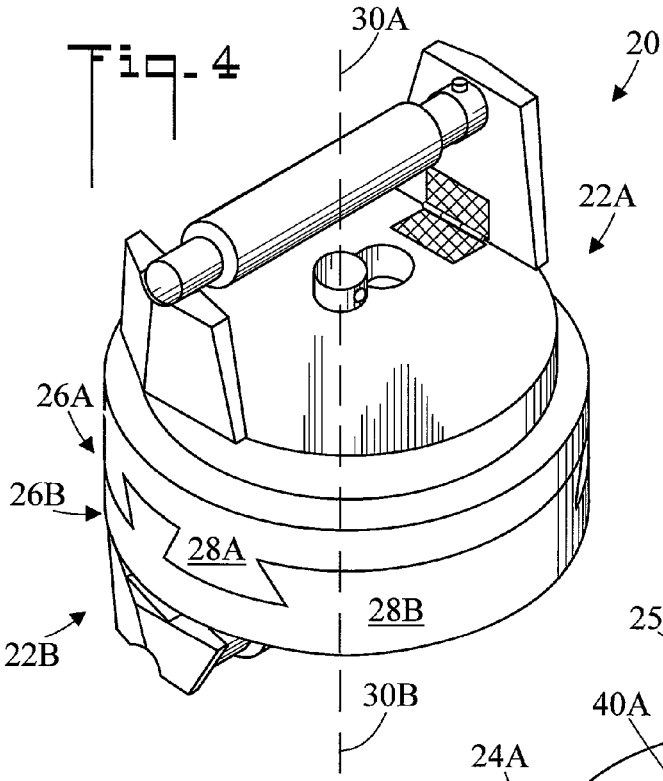
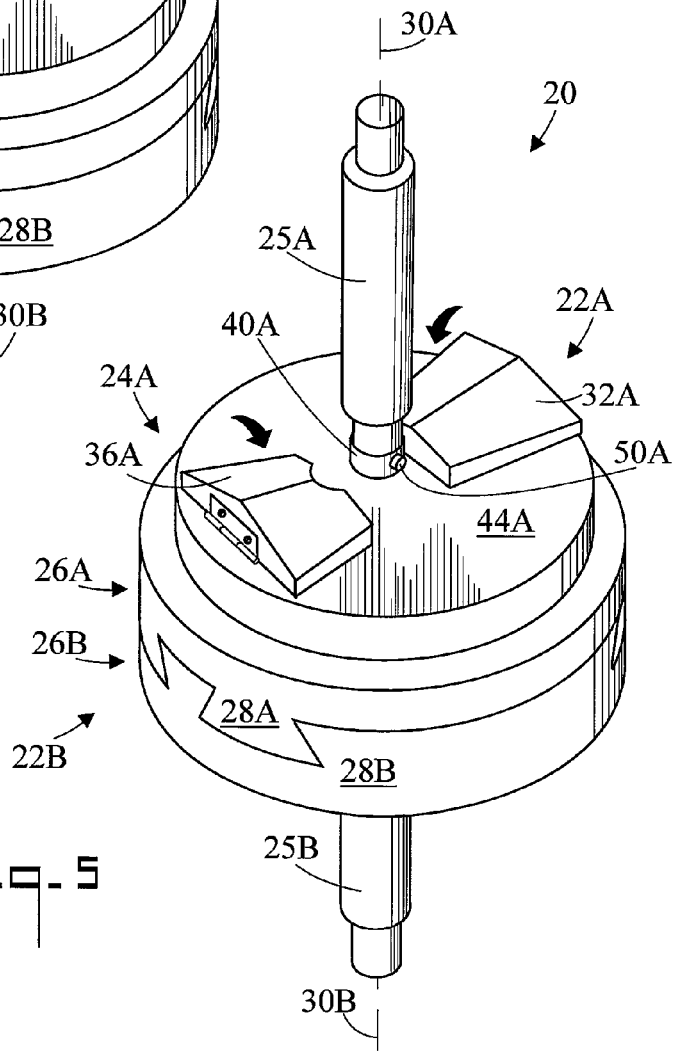
Fig. 5

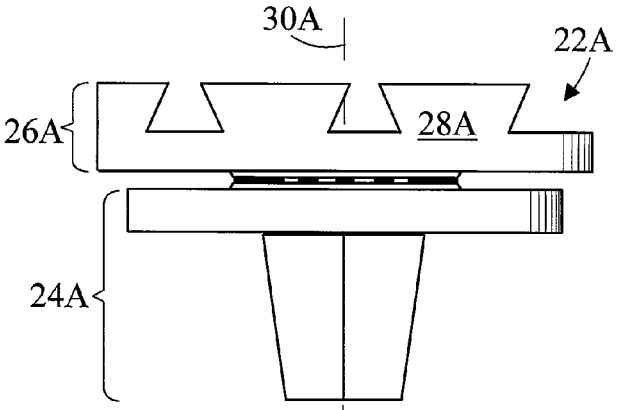
Fig. 8
Fig. 9
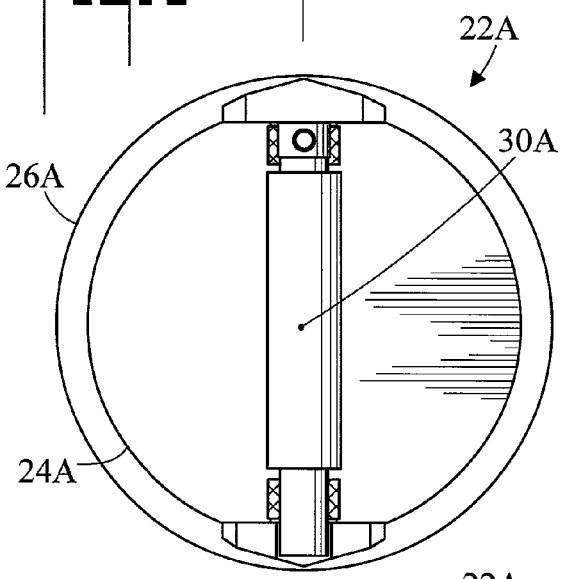
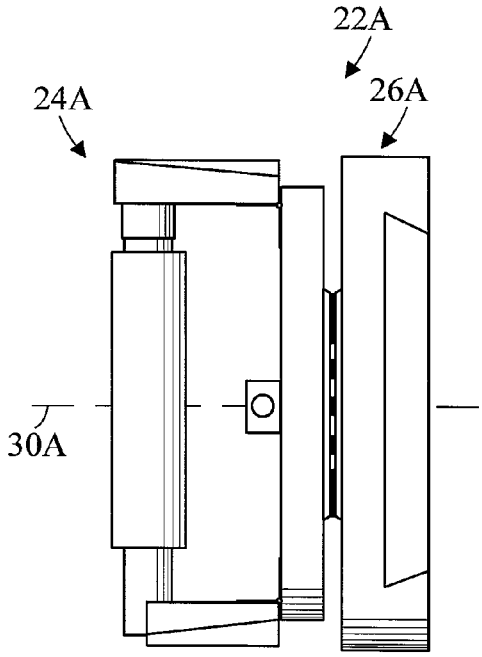
Fig. 10
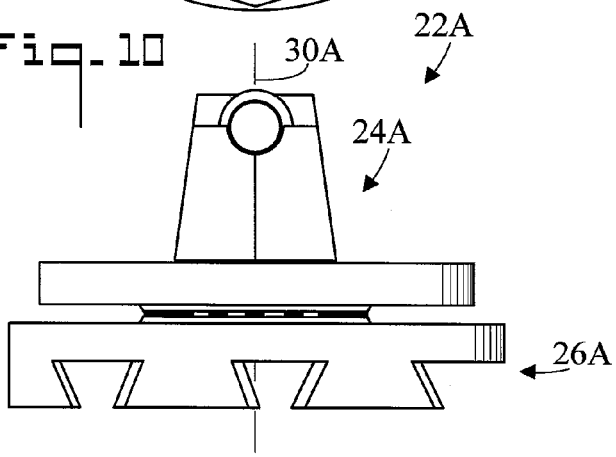
Fig. 11

Fig. 25
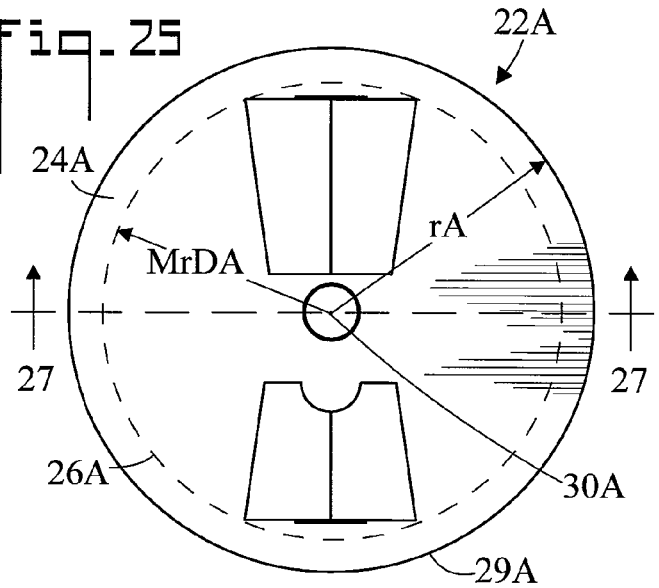
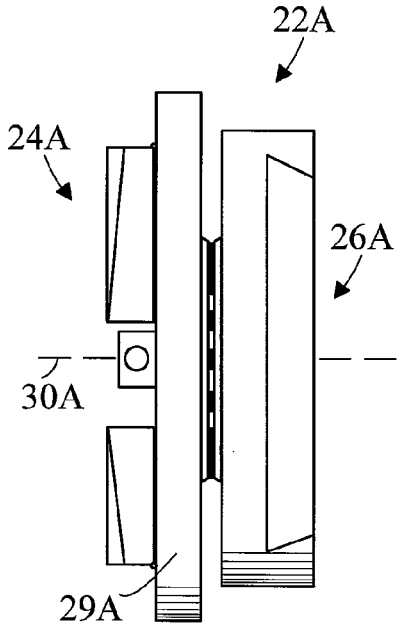
Fig. 26
Fig. 27
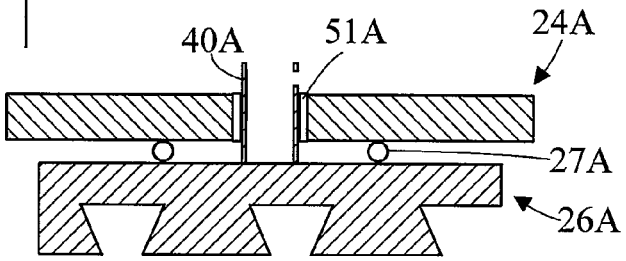
Fig. 28
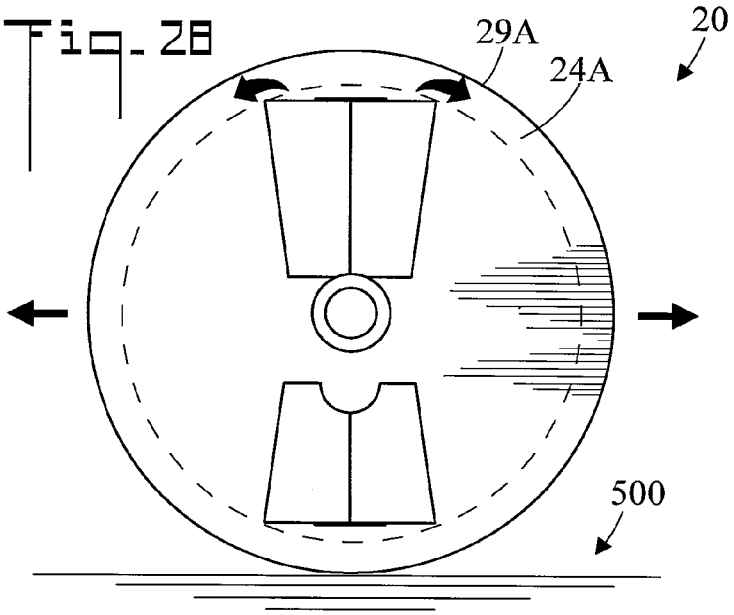

TRANSFORMABLE FITNESS DEVICE AND METHOD OF USE

CROSS REFERENCE TO RELATED APPLICATION

None.

TECHNICAL FIELD

The present invention pertains generally to fitness devices, and more particularly to a fitness device which can be configured as a push-up exercise device and as an exercise wheel.

BACKGROUND OF THE INVENTION

Push-up exercise devices are known in the art. Such a device is shown in U.S. Pat. No. 7,468,025. That device consists of two handle assemblies, each of which is rotatably connected to a base by a turntable (Lazy Susan) bearing. The user places the device on a support surface such as a floor, and grips one of the handle assemblies with each hand and performs push-up exercises. When the user's body is down near the support surface the handles of the handle assemblies rotate substantially parallel to the user's body. When the user's body is up in an arm extend position, the handles naturally rotate substantially perpendicular to the user's body. The rotation of the device lessens the strain on the user's arms when doing a push-up.

Exercise wheels are another form of exercise device which is known in the art. These devices, sometimes referred to as "ab wheels", include a central wheel and two axially projecting handles. A user grips the handles and rolls the device on a support surface. In other forms the exercise wheel can be adapted for use with the feet, as is disclosed in U.S. Pat. No. 6,575,881.

BRIEF SUMMARY OF THE INVENTION

The present invention is directed to a transformable fitness device which can selectively configured as either a push-up exercise device or as an exercise wheel, thereby incorporating both features in a single unit. The transformation from the push-up exercise device to the exercise wheel is effected by connecting the two push-up exercise devices together, and repositioning the handles to an axial location.

In accordance with an embodiment, a transformable fitness device for use on a support surface includes a first assembly having a first central axis. The first assembly also includes a first handle holder. A first base is rotatably connected to the first handle holder, the first base having a first circular rim. The first handle holder and the first base rotate about the first central axis. The transformable fitness device also includes a second assembly having a second central axis. The second assembly also includes a second handle holder. A second base is rotatably connected to the second handle holder, the second base having a second circular rim. The second handle holder and the second base rotate about the second central axis. A connector is provided for removably connecting the first assembly to the second assembly so that the first central axis and the second central axis are coaxial, and so that the first and second circular rims are rollable on the support surface.

In accordance with another embodiment, the connector includes the first base slidably interlocking with the second base, wherein to effect the interlocking at least one of (1) the first base slidably moves perpendicular to the second central axis, and (2) the second base slidably moves perpendicular to the first central axis.

In accordance with another embodiment, the connector includes the first base having a rail, and the second base having a groove which is shaped and dimensioned to slidably engage and interlock with the rail.

In accordance with another embodiment, the rail and the groove are tapered so that the slidable engagement of the rail and the groove stops when the first central axis is coaxial with the second central axis.

In accordance with another embodiment, the first base has a first radius, and the first handle holder has a first maximum radial dimension. The first radius is greater than the first maximum radial dimension. The second base has a second radius which is equal to the first radius of said first base. The second handle holder has a second maximum radial dimension. The second radius is greater than the second maximum radial dimension.

In accordance with another embodiment, the first assembly includes a first handle. The first handle holder includes a first axial connector which is oriented along first central axis, the first axial connector is shaped and dimensioned to removably receive first handle. The second assembly includes a second handle. The second handle holder includes a second axial connector which is oriented along the second central axis, the second axial connector is shaped and dimensioned to removably receive the second handle.

In accordance with another embodiment, the first handle holder includes a first stanchion which has a first handle connector which is shaped and dimensioned to removably receive the first handle. The first handle holder includes a second stanchion which is spaced apart from the first stanchion, the second stanchion has a first recess for removably accepting the first handle, so that the first handle can be connected between the first and second stanchions of the first handle holder. The second handle holder includes a first stanchion which has a second handle connector which is shaped and dimensioned to removably receive the second handle. The second handle holder includes a second stanchion spaced apart from the first stanchion, the second stanchion has a second recess for removably accepting the second handle, so that the second handle can be connected between the first and second stanchions of the second handle holder.

In accordance with another embodiment, the first handle holder has a first surface. The first stanchion of the first handle holder is rotatably movable to an extended upright position substantially perpendicular to the first surface and to a folded position adjacent the first surface. The second stanchion of the first handle holder is rotatably movable to an extended upright position substantially perpendicular to the first surface and to a folded position adjacent the first surface. The second handle holder has a second surface. The first stanchion of the second handle holder is rotatably movable to an extended upright position substantially perpendicular to the second surface and to a folded position adjacent the second surface. The second stanchion of the second handle holder is rotatably movable to an extended upright position substantially perpendicular to the second surface and to a folded position adjacent the second surface.

In accordance with another embodiment, the first and second stanchions of the first handle holder are lockable in the folded position, and the first and second stanchions of the second handle holder are lockable in the folded position.

In accordance with another embodiment, the first surface of the first handle holder includes a first hole which is shaped and dimensioned to receive the first handle connector when the first stanchion of the first handle holder is in the folded position. The second surface of the second handle holder includes a second hole which is shaped and dimensioned to receive the second handle connector when the first stanchion of the second handle holder is in the folded position.

Other embodiments, in addition to the embodiments enumerated above, will become apparent from the following detailed description, taken in conjunction with the accompanying drawings, which illustrate, by way of example, the principles of the fitness device and method of use.

BRIEF DESCRIPTION OF THE DRAWINGS

FIG. 2 is a perspective view of a first assembly being connected to a second assembly;

FIG. 3 is a top plan view of the first assembly being connected to the second assembly;

FIG. 4 is a perspective view of the first assembly connected to the second assembly;

FIG. 5 is a perspective view of the connected first and second assemblies configured as an exercise wheel;

FIG. 8 is a side elevation view of the first assembly;

FIG. 9 is a top plan view of the first assembly;

FIG. 10 is an opposite side elevation view of the first assembly;

FIG. 11 is a rotated side elevation view of the first assembly;

FIG. 25 is a top plan view of a second embodiment of the handle holder and base;

FIG. 26 is a side elevation view of the second embodiment;

FIG. 27 is a cross sectional view along the line 27-27 of FIG. 25;

FIG. 28 is a side elevation view of the second embodiment rolling on a support surface;

DETAILED DESCRIPTION OF THE INVENTION

Figure 1:
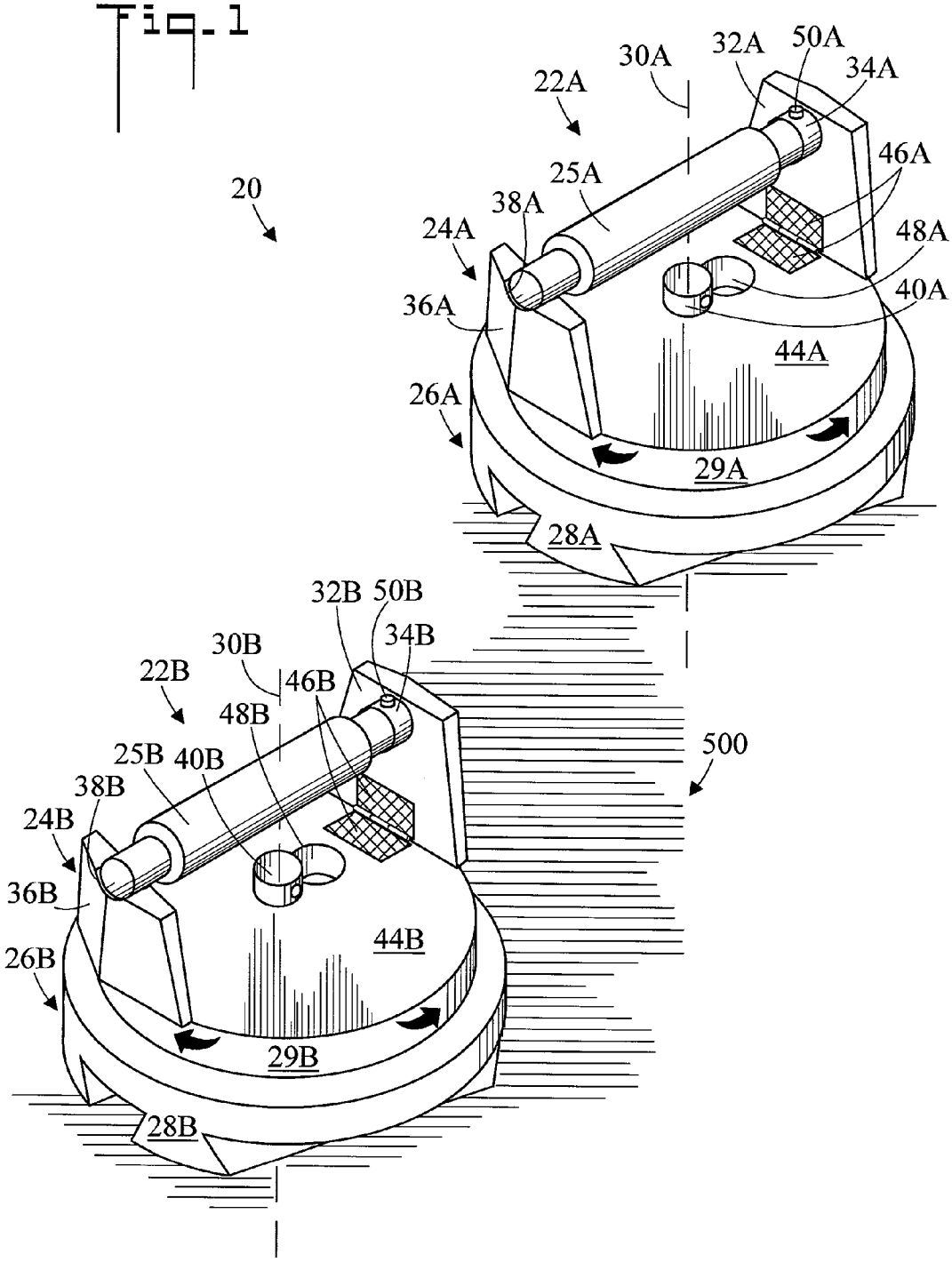
FIG. 1 is a perspective view of a transformable fitness device configured as a push-up exercise device disposed on a support surface.
Figure 31:
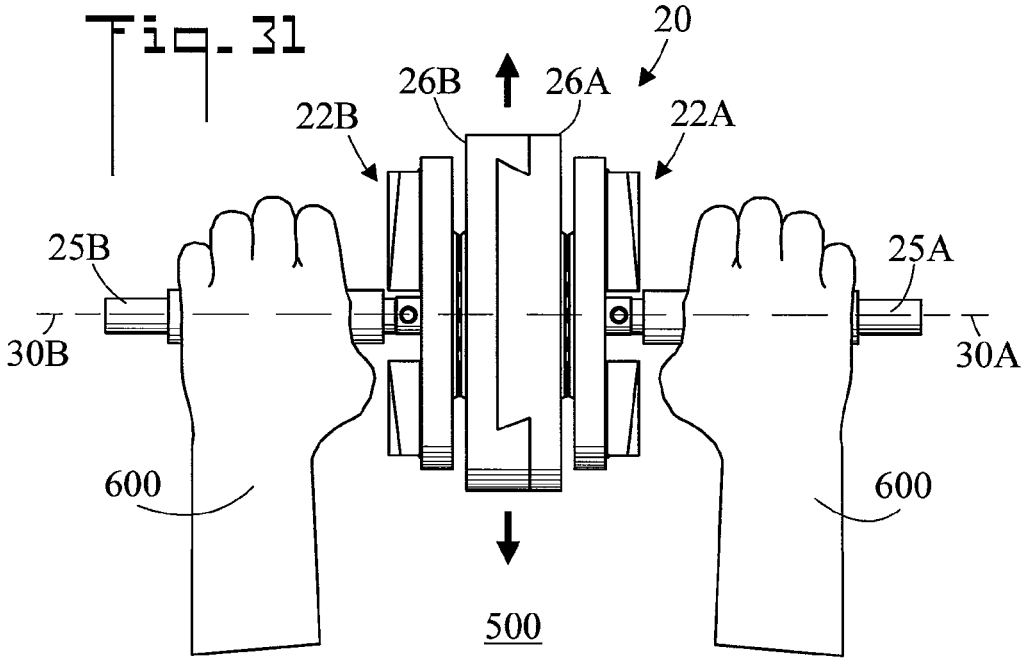
FIG. 31 is a reduced top plan view of the transformable fitness device being used as an exercise wheel; and, FIG. 32 is a reduced top plan view of the second embodiment transformable fitness device being used as an exercise wheel.

Referring initially to FIG. 1, there is illustrated a perspective view of a transformable fitness device 20 configured as a push-up exercise device disposed on a support surface 500 (such a floor). Transformable fitness device 20 includes a first assembly 22A which includes a first central axis 30A, a first handle holder 24A, and a first base 26A. First base 26A is rotatably connected to first handle holder 24A, and has a first circular rim 28A. First handle holder 24A and first base 26A are rotatable about first central axis 30A (also refer to FIGS. 9 and 11). In the shown embodiment, first handle holder 24A and first base 26A are generally disc-shaped and first central axis 30A is the axis about which the discs can rotate. The rotation is effected by a first turntable bearing (a.k.a Lazy Susan turntable) 27A connected between first handle holder 24A and first base 26A (refer to FIGS. 15-18 and the associated discussions). Transformable fitness device 20 further includes a second assembly 22B which includes a second central axis 30B, a second handle holder 24B, and a second base 26B. Second base 26B is rotatably connected to second handle holder 24B, and has a second circular rim 28B. In the shown embodiment, first circular rim 28A and second circular rim 28B are the same size (have equal radii). Second handle holder 24B and second base 26B are rotatable about second central axis 30B. In the shown embodiment the rotation is effected by a first turntable bearing (a.k.a Lazy Susan turntable) connected between second handle holder 24B and second base 26B. A connector is provided for removably connecting first assembly 22A to second assembly 22B so that said first central axis 30A and said second central axis 30B are coaxial, and so that first 28A and second 28B circular rims are rollable (capable of being rolled) on support surface 500 (refer to FIGS. 4 and 7). As used herein, the term "coaxial" means that first central axis 30A and second central axis 30B are aligned to form a common axis which includes both first central axis 30A and second central axis 30B. In other words, first central axis 30A and second central axis 30B are both disposed along the same straight line as is shown in FIGS. 4 and 31.

Figure 29:
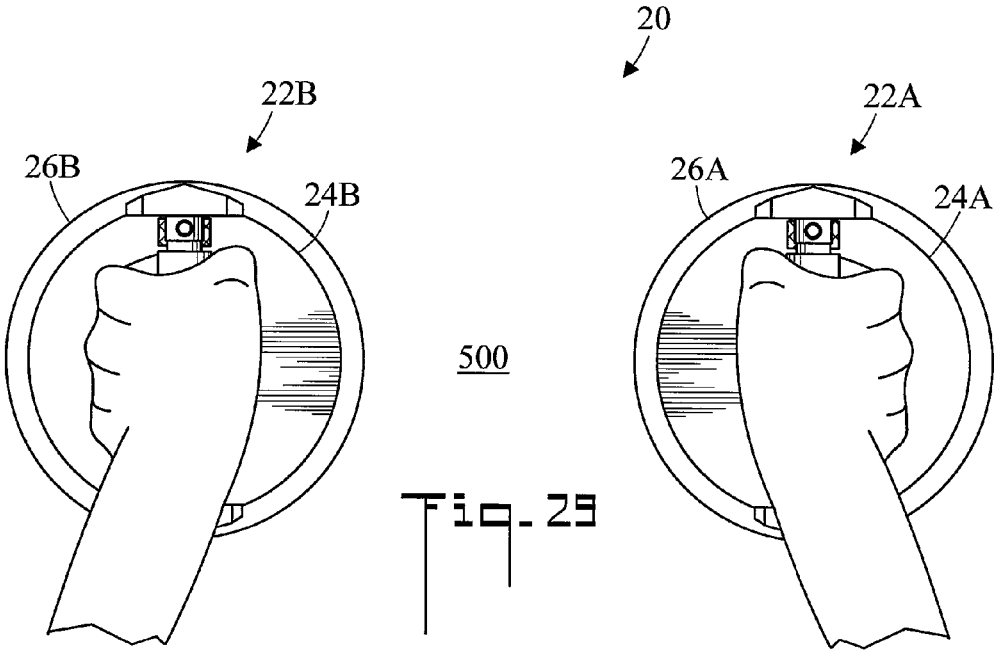
FIG. 29 is a top plan view of the transformable fitness device being used as a push-up exercise device, with the user's arms in a downward position.
Figure 30:
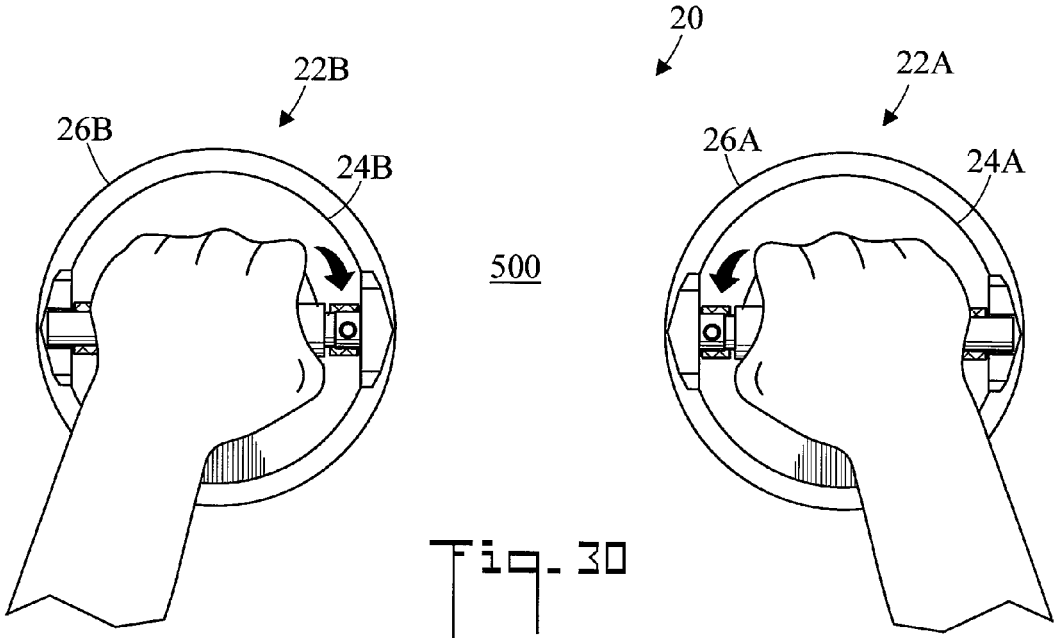
FIG. 30 is a top plan view of the transformable fitness device with the user's arms in an upward extended position.

It is noted that in the push-up configuration of FIG. 1, first 26A and second 26B bases are placed on support surface 500, and first 24A and second 24B handle holders rotate about first central axis 30A and second central axis 30B respectively (also refer to FIGS. 29 and 30).

Figure 21:
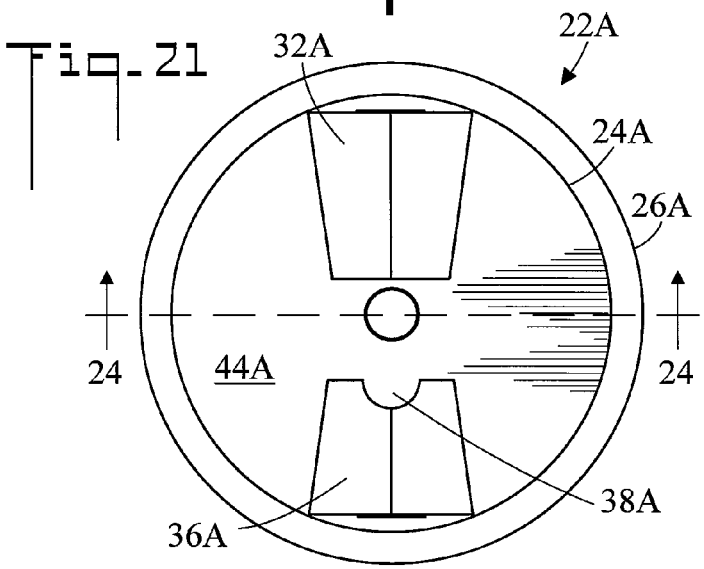
FIG. 21 is an opposite side elevation view of the handle holder and base.

First assembly 22A also includes a first handle 25A. First handle holder 24A includes a first stanchion 32A having a first handle connector 34A which is shaped and dimensioned to removably receive first handle 25A. First handle holder 24A also includes a second stanchion 36A which is spaced apart from first stanchion 32A, second stanchion 36A has a first semicircular recess 38A for removably accepting first handle 25A (also refer to FIG. 21). As shown in FIG. 1, first handle 25A can be connected between first 32A and second 36A stanchions of first handle holder 24A. Similarly, second assembly 22B includes a second handle 25B. Second handle holder 24B includes a first stanchion 32B having a second handle connector 34B which is shaped and dimensioned to removably receive second handle 25B. Second handle holder 24B also includes a second stanchion 36B which is spaced apart from first stanchion 32B, second stanchion 36B has a second semicircular recess 38B for removably accepting second handle 25B. As shown in FIG. 1, second handle 25B can be connected between first 32B and second 36B stanchions of second handle holder 24B. It is noted that in the shown embodiment first assembly 22A and second assembly 22B are structurally identical, except the connector configuration of first base 26A differs from that of second base 26B, as is discussed below.

First handle holder 24A includes a first axial connector 40A which is oriented along first central axis 30A. First axial connector 40A is shaped and dimensioned to removably receive first handle 25A (refer to FIG. 5). Similarly, second handle holder 24B includes a second axial connector 40B which is oriented along second central axis 30B. Second axial connector 40B is shaped and dimensioned to removably receive second handle 25B (refer to FIG. 6).

FIGS. 2 and 3 are perspective and top plan views respectively of first assembly 22A being connected to second assembly 22B. In the shown embodiment, the connector which removably connects first assembly 22A to second assembly 22B includes first base 26A slidably interlocking with second base 26B, wherein to effect the interlocking at least one of (1) first base 26A slidably moves perpendicular to second central axis 30B, and (2) second base 26B slidably moves perpendicular to first central axis 30A. In other words, first base 26A and second base 26B are radially moved toward one another until they merge together into one unit as is shown in FIG. 4. In the shown embodiment, the connector includes first base 26A having a rail 42A, and second base 26B having a groove 43B which is shaped and dimensioned to slidably engage and interlock with rail 42A. The sliding is in the direction of the arrows. In the shown embodiment, rail 42A has a dovetail shape with angled sides, and groove 43B has the same dovetail shape with angled walls so that rail 42A can be slidably received by groove 43B. The angled sides and walls hold the base 26A of first assembly 22A and the base 26B of second assembly 22B together in interlocked relationship by preventing relative movement along axes 30A and 30B. In the shown embodiment, both first base 26A and second base 26B have three rails and three grooves. Also, in the shown embodiment, rail 42A and groove 43B are tapered (refer to FIGS. 12 and 23) so that the slidable engagement of rail 42A and groove 43B stops when first central axis 30A is coaxial with second central axis 30B. It may be appreciated that while the above-disclosed interlocking connector is effective, other methods of connecting first assembly 22A to second assembly 22B could also be employed (e.g. threaded engagement of the two bases, pins, screws, etc.).

FIG. 4 is a perspective view of first assembly 22A fully connected to second assembly 22B. Bases 26A and 26B have been joined so that first central axis 30A is coaxial with second central axis 30B (also refer to FIG. 31), and so that first circular rim 28A and second circular rim 28B are adjacent and can be rolled on support surface 500 (refer to FIGS. 6 and 7). In this fully connected position, all of the interlocking grooves in first base 26A and second base 26B are filled with corresponding interlocking rails of the other assembly so that first base 26A and second base 26B form a single solid unit.

Figure 6:
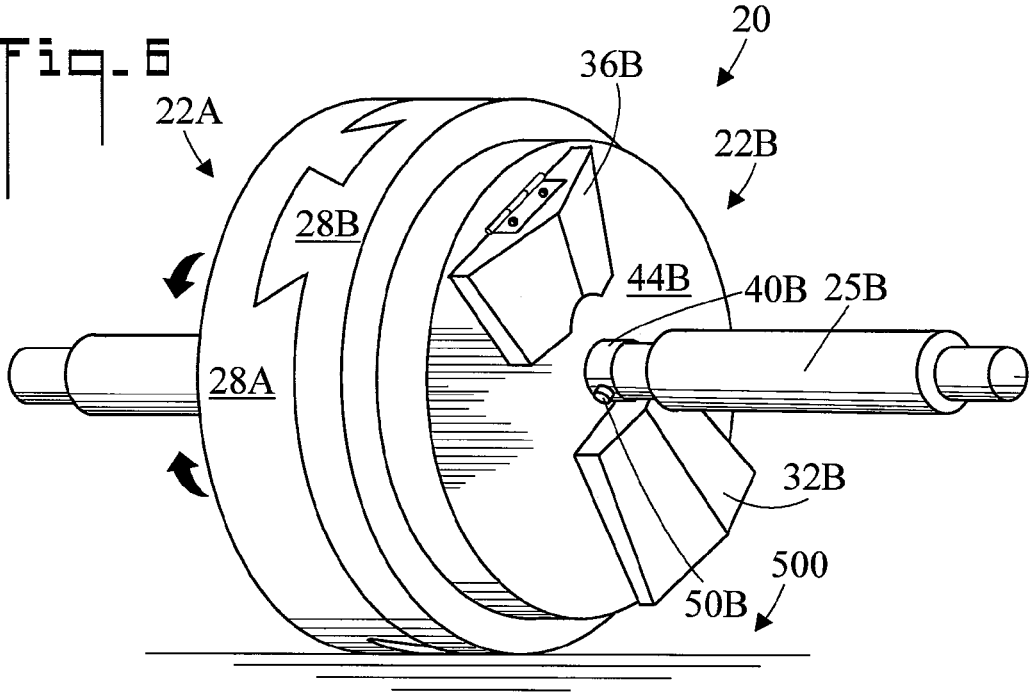
FIG. 6 is a perspective view of the exercise wheel disposed on a support surface.

FIG. 5 is a perspective view of the connected first 22A and second 22B assemblies configured as an exercise wheel. Also referring to FIG. 1, first handle holder 24A has a first surface 44A. First stanchion 32A of first handle holder 24A is rotatably movable to an extended upright position substantially perpendicular to first surface 44A as is shown in FIG. 1 and FIGS. 15-18, and to a folded position adjacent first surface 44A as is shown in FIG. 5 and FIGS. 19-22. Second stanchion 36A of first handle holder 24A is also rotatably movable to an extended upright position substantially perpendicular to first surface 44A as is shown in FIG. 1 and FIGS. 15-18, and to a folded position adjacent first surface 44A as is shown in FIG. 5 and FIGS. 19-22. Similarly, second handle holder 24B has a second surface 44B. First stanchion 32B of second handle holder 24B is rotatably movable to an extended upright position substantially perpendicular to second surface 44B as is shown in FIG. 1, and to a folded position adjacent second surface 44B as is shown in FIG. 6. Second stanchion 36B of second handle holder 24B is also rotatably movable to an extended upright position substantially perpendicular to second surface 44B as is shown in FIG. 1, and to a folded position adjacent second surface 44B as is shown in FIG. 6. In an embodiment, first 32A and second 36A stanchions of first handle holder 24A are lockable in the folded position of FIG. 5. Similarly, first 32B and second 36B stanchions of second handle holder 24B are lockable in the folded position as is shown in FIG. 6. In the shown embodiment, the locking is effected by cooperating hook-and-loop fasteners 46A and 46B attached to the stanchions (32A, 36A, 32B, 36B) and to the surfaces 44A and 44B (refer to FIG. 1). The locking in the folder position is useful in keeping the stanchion out of the way of the user's hands when transformable fitness device 20 is being used as an exercise wheel (refer to FIG. 31). In another embodiment, the stanchions can also lock in the extended upright position.

Referring again to FIG. 1, first surface 44A of first handle holder 24A includes a first hole 48A which is shaped and dimensioned to receive first handle connector 34A when first stanchion 32A of first handle holder 24A is in the folded position of FIG. 5. This allows first stanchion 32A to lay flat against first surface 44A (also refer to FIGS. 18 and 22). Similarly, second surface 44B of second handle holder 24B includes a second hole 48B which is shaped and dimensioned to receive second handle connector 34B when first stanchion 32B of second handle holder 24B is in the folded position. It is also noted in FIGS. 5 and 6, that first 25A and second 25B handles have been removed from the stanchions and connected to first 40A and second 40B axial connectors respectively. This allows a user to use transformable fitness device 20 as an exercise wheel as is shown in FIG. 31.

Figure 7:
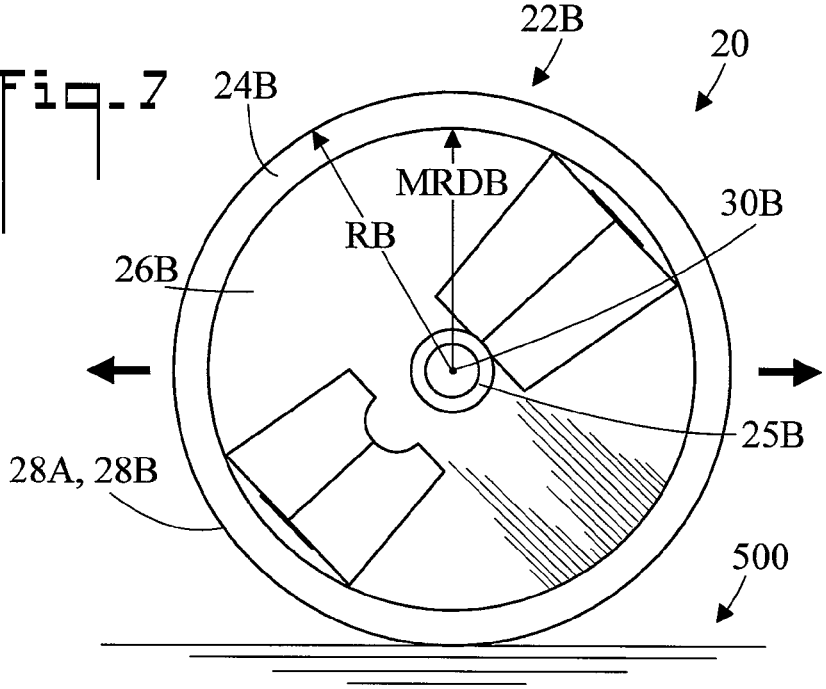
FIG. 7 is a side elevation view of the exercise wheel disposed on the support surface.

FIGS. 6 and 7 are perspective and side elevation views respectively of the transformable fitness device 20 configured as an exercise wheel and disposed on support surface 500 (also refer to FIG. 31). The combined first 22A and second 22B assemblies roll on first circular rim 28A and second circular rim 28B. Also shown are, first and second stanchions 32B and 36B, second axial connector 40B, second surface 44B, and second handle 25B.

FIGS. 8-12 are side elevation, top plan, opposite side elevation, rotated side elevation, and bottom plan views respectively of first assembly 22A. It is noted that in the shown embodiment first assembly 22A is identical to second assembly 22B except for the interlocking connectors 42A and 43B (refer to FIGS. 2 and 3 and the associated discussion). In an embodiment, circular rim 28A includes a friction enhancing material to facilitate rolling on a smooth support surface 500 such as a slick floor. Also, in FIG. 12 the bottom surface (shown with shading) of base 26A includes a friction enhancing material for the same reason. Also shown in the figures are first handle holder 24A, first base 26A, and first central axis 30A.

Figure 12:
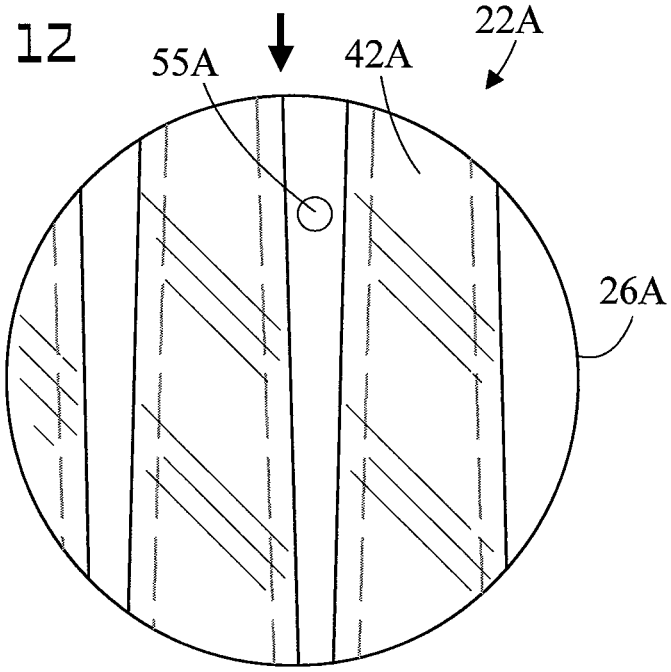
FIG. 12 is a bottom plan view of the first assembly.

Also referring to FIG. 2, in FIG. 12 the area shown with shading comprises the bottom surface of first base 26A which includes the bottom surface of rail 42A. Conversely, the white areas comprise grooves which interlock the rails of second base 26B. As in FIG. 2, the arrow indicates the direction in which second base 26B slidably interlocks with first base 26A. The dashed lines in FIG. 12 indicate the base of the angled sides of the dovetail-shaped rail 42A (also refer to FIG. 2). Also, as is common practice, first base 26A has a screw access hole 55A for connecting and disconnecting turntable bearing 27A (refer to FIGS. 15-18).

Figure 13:
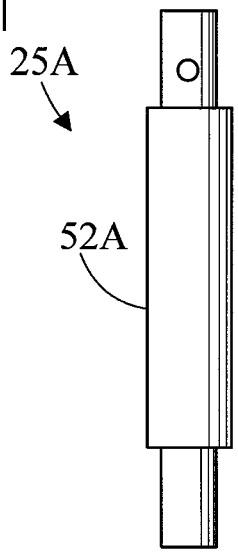
FIG. 13 is a side elevation view of a handle.
Figure 14:
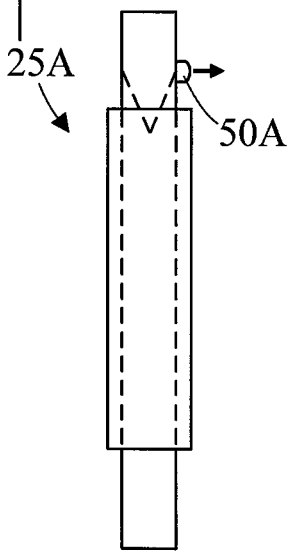
FIG. 14 is a side elevation view of the handle showing a spring plunger connector.
Figure 15:
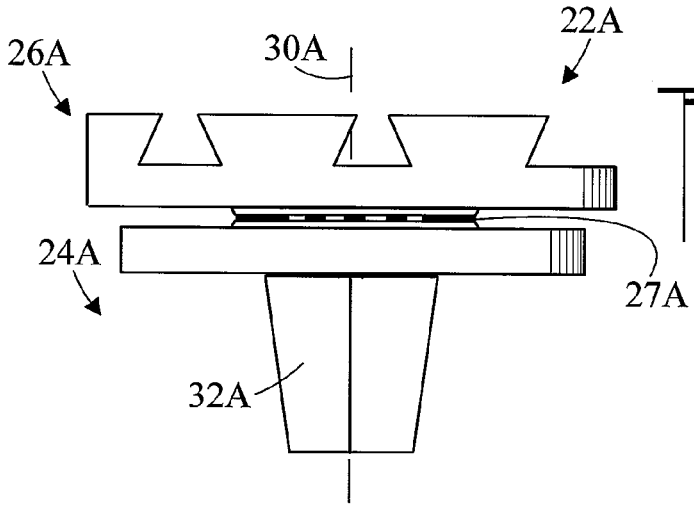
FIG. 15 is a side elevation view of the first assembly with a handle holder rotatably connected to a base, and with first and second stanchions in an extended upright position.

FIG. 13 is a side elevation view of handle 25A, and FIG. 14 is a side elevation view of handle 25A showing a first spring plunger connector 50A. First spring plunger connector 50A is outwardly biased as shown, and cooperates with a hole in first handle holder 34A to lock first handle 25A to first stanchion 32A (refer to FIG. 1). First spring plunger connector 50A also cooperates with first axial connector 40A to lock first handle 25A to first handle holder 24A (refer to FIG. 5). Similarly, second handle 25B includes a second spring plunger connector 50B (refer to FIG. 1) Also, in the shown embodiment handle 25A has a friction enhancing grip 52A, such as one made of rubber, or having outwardly projecting nubs.

Figure 18:
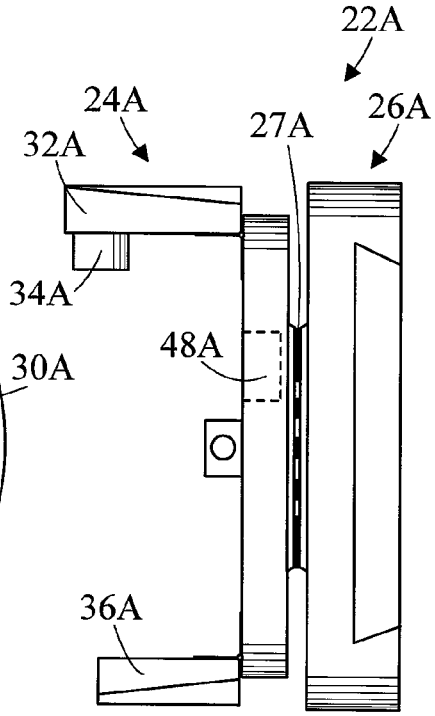
FIG. 18 is a rotated side elevation view of the handle holder and the base.
Figure 17:
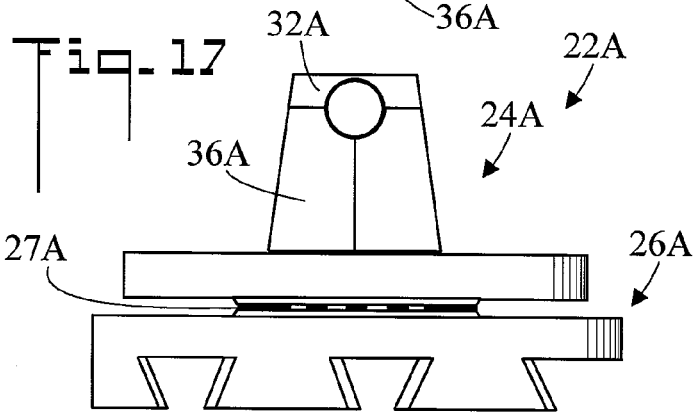
FIG. 17 is an opposite side elevation view of the handle holder and the base.
Figure 19:
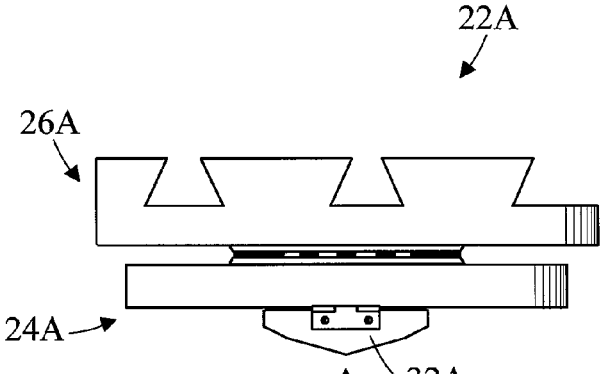
FIG. 19 is a side elevation view of the handle holder and base with the first and second stanchions in a folded position adjacent the surface of the handle holder.

FIGS. 15-18 are side elevation, top plan, opposite side elevation, and rotated side elevation views respectively of first assembly 22A with first handle holder 24A rotatably connected to base 26A, and with first 32A and second 36A stanchions in an extended upright position. In an embodiment, mechanical means (e.g. magnets) can be used to lock first 32A and second 36A stanchions in the upright position. Turntable bearing 27A rotatably connects first handle holder 24A to first base 26A so that both elements can rotate about first axis 30A. Referring to FIG. 18, first handle holder 24A includes first hole 48A which is shaped and dimensioned to receive first handle connector 34A when first stanchion 32A of first handle holder 24A is in the folded position (refer to FIG. 5 and FIG. 19-22).

Figure 16:
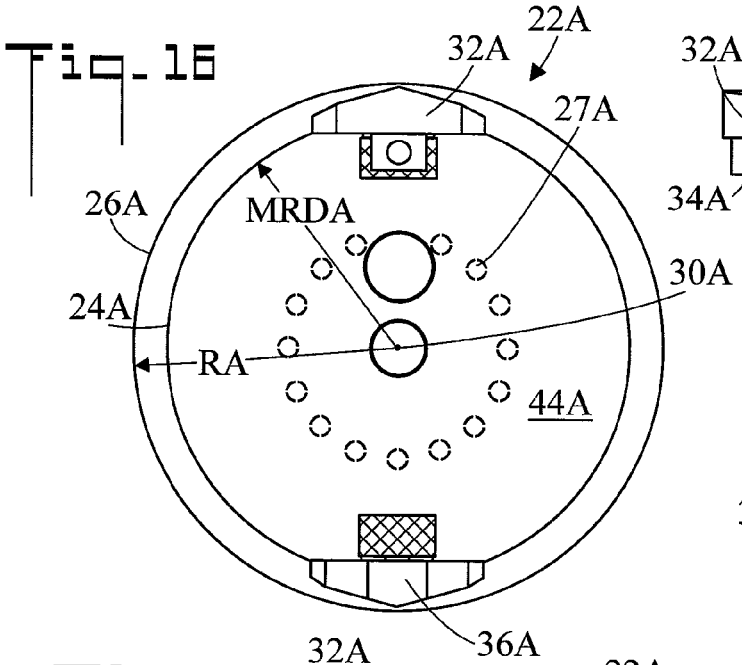
FIG. 16 is a top plan view of the handle holder and base.

Referring to FIG. 16, in the shown embodiment, first base 26A is circular and has a first radius RA measured from first central axis 30A. First handle holder 24A has a first maximum radial dimension MRDA, which is defined as the maximum distance any portion of first handle holder 24A extends from first central axis 30A. In the shown embodiment, first handle holder 24A is circular, and first maximum radial dimension MRDA is the radius of the circle. However, it may be appreciated that first handle holder 24A could have an non-circular shape, and the MRDA would be the maximum distance any part of first handle holder 24A extends from first central axis 30A. First radius RA is greater than first maximum radial dimension MRDA. Similarly, referring to FIG. 7, second base 26B is circular and has a second radius RB (measured from second central axis 30B) which is equal to first radius RA of first base 26A. Second handle holder 24B has a second maximum radial dimension MRDB. Second radius RB is greater than second maximum radial dimension MRDB. Because the radii of the circular bases are greater than the maximum radial dimension of the handle holders, it is guaranteed that when first assembly 22A is connected to second assembly 22B the connected assemblies are rollable on the circular bases (refer to FIGS. 5-7, and 31).

Figure 22:
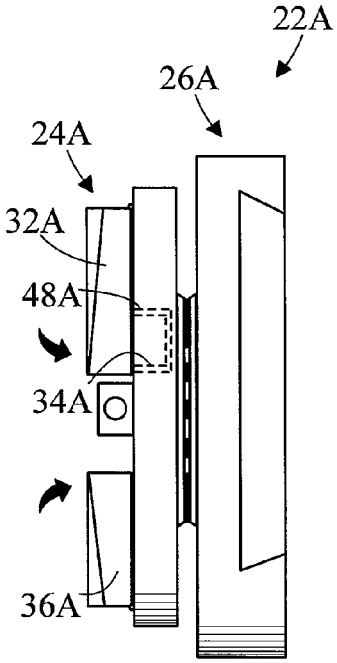
FIG. 22 is a rotated side elevation view of the handle holder and base.

FIG. 19-22 are side elevation, top plan, opposite side elevation, and rotated side elevation views respectively of first assembly 22A with first handle holder 24A rotatably connected to first base 26A, and with first 32A and second 36A stanchions in a folded position adjacent the surface 44A of first handle holder 24A. In FIG. 22 it is noted that first hole 48A receives first handle connector 34A.

Figure 23:
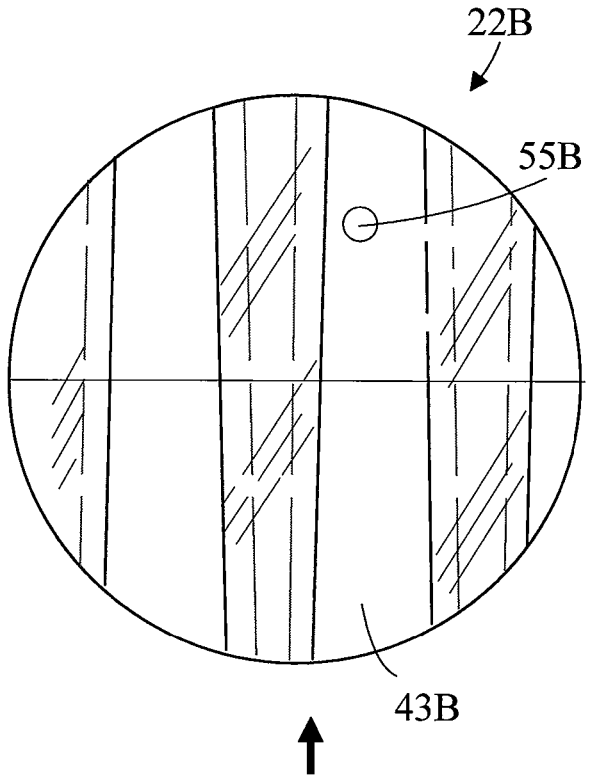
FIG. 23 is a bottom plan view of the second assembly.

FIG. 23 is a bottom plan view of second assembly 22B. Also referring to FIG. 2, the area shown with shading comprises the bottom surface of second base 26B which in the shown embodiment includes three rails which interlock with three corresponding grooves in first base 26A (refer to FIG. 12). Conversely, the white areas comprise grooves which interlock corresponding rails of first base 26A. As in FIG. 12, the arrow indicates the direction in which second base 26B slidably interlocks with first base 26A. The dashed lines in FIG. 23 indicate the base of the angled sides of the dovetail-shaped rails. Also, as is common practice, second base 26B has a screw access hole 55B for connecting and disconnecting the turntable bearing 27A (refer to FIGS. 15-18). It is noted that first axial connector 40A is fixedly connected to first handle holder 24A.

Figure 20:
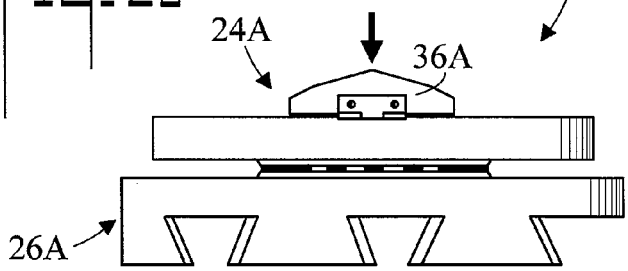
FIG. 20 is a top plan view of the handle holder and base.
Figure 24:
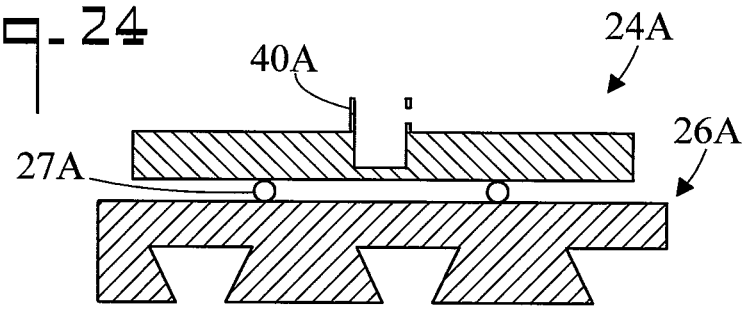
FIG. 24 is a cross sectional view along the line 24-24 of FIG. 20.

FIG. 24 is a cross sectional view along the line 24-24 of FIG. 20. Shown are first handle holder 24A, first base 26A, turntable bearing 27A, and first axial connector 40A.

FIGS. 25-26 are top plan and side elevation views respectively of second embodiment of first handle holder 24A and first base 26A. This embodiment differs from the previously described embodiment in that when first assembly 22A and second assembly 22B are connected as an exercise wheel (refer to FIGS. 5-7), in the second embodiment the combination rolls on first 24A and second 24B handle holders rather than upon first 26A and second 26B bases. First assembly 22A includes first handle holder 24A which has a circular rim 29A. First base 26A is rotatably connected to first handle holder 24A. First handle holder 24A is rotatable about a first central axis 30A (refer to FIG. 1). Second assembly 22B includes second handle holder 24B having a circular rim 29B. Second base 26B is rotatably connected to second handle holder 24B. Second handle holder 24B is rotatable about a second central axis 30B. A connector removably connects first assembly 22A to second assembly 22B so that first central axis 30A and second central axis 30B are coaxial, and first 29A and second 29B circular rims can roll on support surface 500 (refer to FIG. 32).

Figure 32:
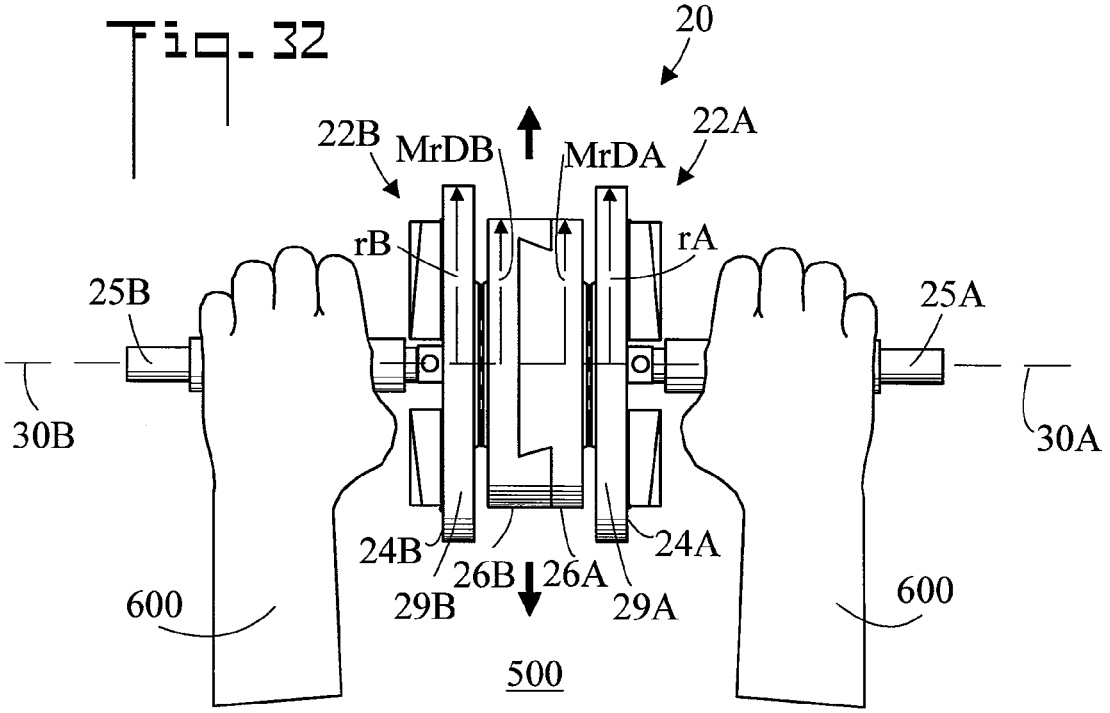

Referring to FIG. 25, in the shown embodiment, first handle holder 24A is circular and has a first radius rA measured from first central axis 30A. First base 26A has a first maximum radial dimension MrDA, which is defined as the maximum distance any portion of first base 26A extends from first central axis 30A. First radius rA is greater than first maximum radial dimension MrDA. Referring to FIG. 32, second handle holder 24B is circular has a second radius rB which is equal to first radius rA of first handle holder 24A. Second base 26B has a second maximum radial dimension MrDB. Second radius rB is greater than second maximum radial dimension MrDB. Because the radii of the circular handle supports are greater than the maximum radial dimension of the bases, it is guaranteed that when first assembly 22A is connected to second assembly 22B the connected assemblies are rollable on the circular handle holders (refer to FIGS. 28 and 32).

FIG. 27 is a cross sectional view along the line 27-27 of FIG. 25. Shown are first handle holder 24A, first base 26A, turntable bearing 27A, and first axial connector 40A. It is noted that in this embodiment, first axial connector 40*a* is fixedly connected to first base 26A (rather than to first handle holder 24A). A bearing 51A permits first handle holder 24A to rotate about first axial connector 40A.

FIG. 28 is a side elevation view of the second embodiment rolling on support surface 500. Circular rim 29A of first handle holder 24A rolls on support surface 500.

FIG. 29 is a top plan view of first assembly 22A and second assembly 22B of transformable fitness device 20 being used as a push-up exercise device, with the user's arms in a downward position. FIG. 30 is a top plan view of transformable fitness device 20 with the user's arms in an upward extended position. It is noted that first 24A and second 24B handle holders rotate with respect to first 26A and second 26B bases respectively about 90° when transitioning from the position of FIG. 29 to the position of FIG. 30.

FIG. 31 is a reduced top plan view of transformable fitness device 20 being used as an exercise wheel. First 22A and second 22B assemblies have been connected as previously described. The user's hands 600 grip handles 25A and 25B and roll transformable fitness device 20 on support surface 500. It is noted that transformable fitness device 20 rolls on first 26A and second 26B bases. It may be appreciated that transformable fitness device 20 can be configured as the shown "ab" wheel, but could also include longer handles 25*a* and 25B and attachments to permit use by the feet. It is noted that in the exercise wheel configuration of FIG. 31, the user grips first 25A and second 25B handles (and therefore first 24A and second 24B handle holders) and it is first 26A and second 26B bases which rotate about first 30A and second 30B central axes.

FIG. 32 is a reduced top plan view of the second embodiment transformable fitness device 20 being used as an exercise wheel. First 22A and second 22B assemblies have been connected as previously described. The user's grip handles 25A and 25B and roll transformable fitness device 20 on support surface 500. It is noted that in this embodiment, transformable fitness device 20 rolls on first 24A and second 24B handle holders.

In terms of use, a method for transforming a pair of push-up exercise devices into an exercise wheel includes: (refer to FIGS. 1-32)

(a) providing a support surface 500;

(b) providing a pair of push-up exercise devices including:

a first assembly 22A including;

a first central axis 30A a first handle 25A;

a first handle holder 24A which removably receives first handle 25A;

a first base 26A rotatably connected to first handle holder 24A;

a second assembly 22B including;

a second central axis 30B;

a second handle 25B;

a second handle holder 24B which removably receives second handle 25B;

a second base 26B rotatably connected to second handle holder 24B;

at least one of (1) first base 26A having a first circular rim 28A and second base 26B having a second circular rim 28B, and (2) first handle holder 24A having a first circular rim 29A and second handle 24B having a second circular rim 29B;

a connector for connecting first assembly 22A to second assembly 22B so that first central axis 30A and second central axis 30B are coaxial, and so that one of (1) first circular rim 28A of first base 26A and second circular rim 28B of second base 26B can roll on support surface 500, and (2) first circular rim 29A of first handle holder 24A and second circular rim 29B of second handle holder 24B can roll on support surface 500; and, (c) using the connector to connect first assembly 22A to second assembly 22B so that first central axis 30A is coaxial with second central axis 30B, and so that one of (1) first circular rim 28A of first base 26A and second circular rim 28B of second base 26B can roll on support surface 500, and (2) first circular rim 29A of first handle holder 24A and second circular rim 29B of second handle holder 24B are rollable on support surface 500.

The method further including:

in (b), the connector including first base 26A slidably interlocking with second base 26B, wherein to effect the interlocking at least one of (1) first base 26A slidably moves perpendicular to second central axis 30B, and (2) second base 26B slidably moves perpendicular to first central axis 30A; and, during (c), sliding first base 26A and second base 26B together in interlocking relationship.

The method further including:

in (b), the connector including first base 26A having a rail 42A, and second base 26B having a groove 43B which is shaped and dimensioned to slidably engage and interlock with rail 42A; and, during (c), rail 42A slidably interlocking with groove 43B.

The method further including:

in (b), rail 42A and groove 43B being tapered so that in (c) the slidable engagement of rail 42A and groove 43B stops when first central axis 30A is coaxial with second central axis 30B.

The method further including;

in (b), first handle holder 24A including a first stanchion 32A having a first handle connector 34A which is shaped and dimensioned to removably receive first handle 25A;

in (b), first handle holder 24A including a second stanchion 36A spaced apart from first stanchion 32A;

in (b), first handle 25A connected between first 32A and second 36A stanchions of first handle holder 24A;

in (b), first handle holder 24A having a first surface 44A;

in (b), first stanchion 32A rotatably movable to an extended upright position substantially perpendicular to first surface 44A and to a folded position adjacent first surface 44A;

in (b), first handle holder 24A including a first axial connector 40A oriented along first central axis 30A, first axial connector 40A shaped and dimensioned to removably receive first handle 25A;

in (b), second handle holder 24B including a first stanchion 32B having a second handle connector 34B which is shaped and dimensioned to removably receive second handle 25B;

in (b), second handle holder 24B including a second stanchion 36B spaced apart from first stanchion 32B;

in (b), said second handle connected between said first and second stanchions of said second handle holder;

in (b), second handle holder 24B having a second surface 44B;

in (b), first stanchion 32B rotatably movable to an extended upright position substantially perpendicular to second surface 44B and to a folded position adjacent second surface 44B;

in (b), second handle holder 24B including a second axial connector 40B oriented along second central axis 30B, second axial 40B connector shaped and dimensioned to removably receive second handle 25B;

disconnecting first handle 25A from first handle holder 24A, and placing first 32A and second stanchions 36A of first handle holder 24A in the folded position;

inserting first handle 25A into first axial connector 40A;

disconnecting second handle 25B from second handle holder 24B, and placing first 32B and second 36B stanchions of second handle holder 24B in the folded position; and, inserting second handle 25B into second axial connector 40B.

In the above-cited method, it may be appreciated that the steps of disconnecting the handles and placing the stanchions in the folded position could be performed before the connection of the bases. It may further be appreciated that transforming the exercise wheel into a pair of push-up exercise devices can be accomplished by reversing the method discussed above.

The embodiments of the fitness device and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is defined by the appended claims.

I claim:

1. A transformable fitness device for use on a support surface, comprising:

a first assembly including;

first central axis;

a first handle holder;

a first base rotatably connected to said first handle holder, said first base having a first circular rim;

said first handle holder and said first base rotatable about said first central axis;

a second assembly including;

a second central axis;

a second handle holder;

a second base rotatably connected to said second handle holder, said second base having a second circular rim;

said second handle holder and said second base rotatable about said second central axis;

a connector for removably connecting said first assembly to said second assembly so that said first central axis and said second central axis are coaxial; and, said connector including said first base slidably interlocking with said second base, wherein to effect said interlocking at least one of (1) said first base slidably moves perpendicular to said second central axis, and (2) said second base slidably moves perpendicular to said first central axis.

2. The transformable fitness device according to claim 1, further including:

said connector including said first base having a rail, and said second base having a groove which is shaped and dimensioned to slidably engage and interlock with said rail.

3. The transformable fitness device according to claim 2, further including:

said rail and said groove being tapered so that said slidable engagement of said rail and said groove stops when said first central axis is coaxial with said second central axis.

4. A transformable fitness device for use on a support surface, comprising:

a first assembly including;

first central axis;

a first handle holder;

a first base rotatably connected to said first handle holder, said first base having a first circular rim;

said first handle holder and said first base rotatable about said first central axis;

a second assembly including;

a second central axis;

a second handle holder;

a second base rotatably connected to said second handle holder, said second base having a second circular rim;

said second handle holder and said second base rotatable about said second central axis;

a connector for removably connecting said first assembly to said second assembly so that said first central axis and said second central axis are coaxial;

said first base having a first radius;

said first handle holder having a first maximum radial dimension;

said first radius being greater than said first maximum radial dimension;

said second base having a second radius which is equal to said first radius of said first base;

said second handle holder having a second maximum radial dimension; and, said second radius being greater than said second maximum radial dimension.

5. A transformable fitness device for use on a support surface, comprising:

a first assembly including;

first central axis;

a first handle holder;

a first base rotatably connected to said first handle holder, said first base having a first circular rim;

said first handle holder and said first base rotatable about said first central axis;

a second assembly including;

a second central axis;

a second handle holder;

a second base rotatably connected to said second handle holder, said second base having a second circular rim;

said second handle holder and said second base rotatable about said second central axis;

a connector for removably connecting said first assembly to said second assembly so that said first central axis and said second central axis are coaxial;

a first handle;

said first handle holder including a first axial connector oriented along said first central axis, said first axial connector shaped and dimensioned to removably receive said first handle;

a second handle; and, said second handle holder including a second axial connector oriented along said second central axis, said second axial connector shaped and dimensioned to removably receive said second handle.

6. A transformable fitness device for use on a support surface, comprising:

a first assembly including;

a first central axis;

a first handle holder having a circular rim;

a first base rotatably connected to said first handle holder;

said first handle holder rotatable about said first central axis;

a second assembly including;

a second central axis;

a second handle holder having a circular rim;

a second base rotatably connected to said second handle holder;

said second handle holder rotatable about a second central axis;

a connector for removably connecting said first assembly to said second assembly so that said first central axis and said second central axis are coaxial; and, said connector including said first base slidably interlocking with said second base, wherein to effect said interlocking at least one of (1) said first base slidably moves perpendicular to said second central axis, and (2) said second base slidably moves perpendicular to said first central axis.

7. The transformable fitness device according to claim 6, further including:

said connector including said first base having a rail, and said second base having a groove which is shaped and dimensioned to slidably engage and interlock with said rail.

8. The transformable fitness device according to claim 7, further including:

said rail and said groove being tapered so that said slidable engagement of said rail and said groove stops when said first central axis is coaxial with said second central axis.

9. A transformable fitness device for use on a support surface, comprising:

a first assembly including;

a first central axis;

a first handle holder having a circular rim;

a first base rotatably connected to said first handle holder;

said first handle holder rotatable about said first central axis;

a second assembly including;

a second central axis;

a second handle holder having a circular rim;

a second base rotatably connected to said second handle holder;

said second handle holder rotatable about a second central axis;

a connector for removably connecting said first assembly to said second assembly so that said first central axis and said second central axis are coaxial;

said first handle holder having a first radius;

said first base having a first maximum radial dimension;

said first radius being greater than said first maximum radial dimension;

said second handle holder having a second radius which is equal to said first radius of said first handle holder;

said second base having a second maximum radial dimension; and, said second radius being greater than said second maximum radial dimension.

10. A method for transforming a pair of push-up exercise devices into an exercise wheel, comprising:

(a) providing a support surface;

(b) providing a pair of push-up exercise devices including:

a first assembly including;

a first central axis;

a first handle;

a first handle holder which removably receives said first handle;

a first base rotatably connected to said first handle holder;

a second assembly including;

a second central axis;

a second handle;

a second handle holder which removably receives said second handle, a second base rotatably connected to said second handle holder;

at least one of (1) said first base having a first circular rim and said second base having a second circular rim, and (2) said first handle holder having a first circular rim and said second handle having a second circular rim;

a connector for connecting said first assembly to said second assembly so that said first central axis and said second central axis are coaxial, and so that one of (1) said first circular rim of said first base and said second circular rim of said second base rollable on said support surface, and (2) said first circular rim of said first handle holder and said second circular rim of said second handle holder rollable on said support surface; and, (c) using said connector to connect said first assembly to said second assembly so that said first central axis is coaxial with said second central axis, and so that one of (1) said first circular rim of said first base and said second circular rim of said second base can roll on said support surface, and (2) said first circular rim of said first handle holder and said second circular rim of said second handle holder can roll on said support surface.

11. The method of claim 10, further including:

in (b), said connector including said first base slidably interlocking with said second base, wherein to effect said interlocking at least one of (1) said first base slidably moves perpendicular to said second central axis, and (2) said second base slidably moves perpendicular to said first central axis; and, during (c), sliding said first base and said second base together in interlocking relationship.

12. The method of claim 11, further including:

in (b), said connector including said first base having a rail, and said second base having a groove which is shaped and dimensioned to slidably engage and interlock with said rail; and, during (c), said rail slidably interlocking with said groove.

13. The method of claim 12, further including:

in (b), said rail and said groove being tapered so that in (c) said slidable engagement of said rail and said groove stops when said first central axis is coaxial with said second central axis.

14. The method of claim 10, further including;

in (b), said first handle holder including a first stanchion having a first handle connector which is shaped and dimensioned to removably receive said first handle;

in (b), said first handle holder including a second stanchion spaced apart from said first stanchion;

in (b), said first handle connected between said first and second stanchions of said first handle holder;

in (b), said first handle holder having a first surface;

in (b), said first stanchion rotatably movable to an extended upright position substantially perpendicular to said first surface and to a folded position adjacent said first surface;

in (b), said first handle holder including a first axial connector oriented along said first central axis, said first axial connector shaped and dimensioned to removably receive said first handle;

in (b), said second handle holder including a first stanchion having a second handle connector which is shaped and dimensioned to removably receive said second handle;

in (b), said second handle holder including a second stanchion spaced apart from said first stanchion;

in (b), said second handle connected between said first and second stanchions of said second handle holder;

in (b), said second handle holder having a second surface;

in (b), said first stanchion rotatably movable to an extended upright position substantially perpendicular to said second surface and to a folded position adjacent said second surface;

in (b), said second handle holder including a second axial connector oriented along said second central axis, said second axial connector shaped and dimensioned to removably receive said second handle;

removing said first handle from said first handle holder, and placing said first and second stanchions of said first handle holder in said folded position;

inserting said first handle into said first axial connector;

removing said second handle from said second handle holder, and placing said first and second stanchions of said second handle holder in said folded position; and, inserting said second handle into said second axial connector.

* * * * *

UNITED STATES PATENT AND TRADEMARK OFFICE

CERTIFICATE OF CORRECTION

PATENT NO. : 9,067,104 B1
APPLICATION NO. : 13/826796
DATED : June 30, 2015
INVENTOR(S) : David Seon Kim It is certified that error appears in the above-identified patent and that said Letters Patent is hereby corrected as shown below:

In the claims
Column 11, in line four of Claim 1, change “first central axis” to -- a first central axis --.
Column 11, in line four of Claim 4, change “first central axis” to -- a first central axis --.
Column 12, in line four of Claim 5, change “first central axis” to -- a first central axis --.

Signed and Sealed this
Eighth Day of December, 2015

Michelle K. Lee

Michelle K. Lee
*Director of the United States Patent and Trademark Office*